United States Patent [19]

DuCorday

[11] Patent Number: 4,863,093

[45] Date of Patent: Sep. 5, 1989

[54] DECORATIVE PORTFOLIO-PRESENTATION FOLDER THAT CAN BE PARTIALLY CONSTRUCTED BY THE USER

[76] Inventor: Gerard M. DuCorday, 10871 Thorley Rd., Santa Ana, Calif. 92705

[21] Appl. No.: 194,450

[22] Filed: May 16, 1988

[51] Int. Cl.[4] ..... B65D 5/00

[52] U.S. Cl. ..... 229/1.5 R; 229/117.15; 312/184; 493/88; 493/102

[58] Field of Search ..... 229/1.5 R, 68 C, 72, 229/52 B; 206/425; 40/359; 383/9, 10; 312/184; 493/88, 102

[56] References Cited

U.S. PATENT DOCUMENTS

| | | | |
|---|---|---|---|
| 140,275 | 6/1973 | Jocelyn . | |
| 806,200 | 12/1905 | Sims | 229/72 |
| 1,435,657 | 11/1922 | Potdevin . | |
| 1,507,156 | 9/1924 | Bunker et al. | 229/68 C |
| 1,738,120 | 12/1929 | Schaffert | 40/359 |
| 1,743,305 | 1/1930 | Banks | 229/1.5 R |
| 1,747,801 | 2/1930 | Topal . | |
| 1,794,560 | 3/1931 | Styll | 229/1.5 R |
| 2,970,687 | 2/1961 | Johnson | 206/62 |
| 3,133,750 | 5/1964 | Gerald | 281/34 |
| 3,164,317 | 1/1965 | Bogen | 229/73 |
| 3,572,767 | 3/1971 | Learned | 281/34 |
| 3,860,164 | 1/1975 | Dworkin | 229/61 |
| 3,885,726 | 5/1975 | Fridlund et al. | 312/184 |
| 3,891,240 | 6/1975 | DuCorday | 281/29 |
| 4,262,838 | 4/1981 | Mackenzie | 229/72 |
| 4,355,822 | 10/1982 | McHugh | 281/34 |
| 4,531,667 | 7/1985 | Meade | 229/1.5 R |
| 4,793,495 | 12/1988 | Preu | 312/184 |

FOREIGN PATENT DOCUMENTS

| | | | |
|---|---|---|---|
| 1801567 | 7/1970 | Fed. Rep. of Germany | 312/184 |
| 611159 | 9/1926 | France | 312/184 |
| 928933 | 12/1947 | France | 312/184 |
| 1038761 | 10/1953 | France | 312/184 |
| 88302 | 1/1937 | Sweden | 40/359 |
| 312570 | 5/1929 | United Kingdom | 229/68 C |

OTHER PUBLICATIONS

Pages 22, 23 and 24 of the "Bro-Dart Library Supplies 1971/72" library catalog of Bro-Dart Incorporated.

Page 49 of the "Gaylord" library catalog, 1969-70 of Gaylord Brothers, Inc.

*Primary Examiner*—Stephen P. Garbe

*Attorney, Agent, or Firm*—Gausewitz, Carr & Rothenberg

[57] ABSTRACT

A portfolio presentation folder is made of a single blank sheet of cardboard for custom decoration and instant assembly by the user in a home, school or office environment. The blank sheet is separable into a pocket part and a front cover part so that the latter may be separately and independently decorated by standard office machines, desk-top publishing equipment, etc., or by hand. Both parts are provided with cutouts forming handle flaps and handle openings arranged for registry with one another so as to provide strong, multi-layered handle regions when the cover and pocket parts are connected to one another after the pocket part has been folded to form a pocket.

36 Claims, 4 Drawing Sheets

11
13
14b
14a
19
18
20
16
15
17
10
37
28
26
25
27
24
35
30
29
31
2
35
12
38
2
36
36
32
32
21
33
33
34
34
22
39
23
40
38
42
21

DECORATIVE PORTFOLIO-PRESENTATION FOLDER THAT CAN BE PARTIALLY CONSTRUCTED BY THE USER

BACKGROUND OF THE INVENTION

In the presentation of advertising materials, documents, reports, proposals, merchandise, samples, etc., it is common to use book-style presentation folders. These are carried spinedown, with their covers pinched together in order to prevent the contents from falling out of the open sides or edges. Furthermore, and very importantly, such conventional book-style presentation folders cannot practically be "customized" for each job. That is to say, they cannot practically be decorated in a manner which tailors the appearance of the presentation folder to the particular job being done or customer or recipient to be addressed. Existing presentation folders can be custom-imprinted, but only in large printing plants at high cost and in an average of about six weeks, considering that after the imprinting, there follow the die-cutting, scoring, folding and gluing operations, all of this being impractical for small-lot productions.

SUMMARY OF THE INVENTION

In accordance with one aspect of the present invention, it is made practical for the end user to aid in constructing presentation folders, including customized presentation folders that are tailored to particular jobs, customers or individuals. The present portfolio-style folders provide safe handling and convenient portability of contents. Furthermore, they present an elegant, diplomat/attache look, which is made especially effective by a highly-decorative front cover which becomes part of a handle and closure assembly. The front cover is custom printable, foil stampable, embossable, etc., to achieve various highly-desirable decorative effects.

In accordance with another aspect of the present invention, a portion of the presentation folder is of appropriate size and thickness for use in desk-top apparatus that can perform small lot or individual printing, foil stamping, colorplating, embossing, headlining, laminating, etc., operations. Then, after the decorating has occurred, such portion is quickly, easily and correctly assembled with the remainder of the presentation folder, thus making practical a relatively self-manufactured folder having a highly-decorative and customized appearance, and which can be made in very small lots.

In accordance with a further aspect of the present invention, the presentation folder has a handle portion which is extremely strong, being laminated by the user into different thicknesses of handle depending on which embodiment of the present invention is employed. Furthermore, the present folders may be relatively thick—for relatively large and heavy contents—or may be quite thin in order to maximize the economy of the folders. Carrying comfort is provided by the wrap-around design of the adhesive handle opening spaces (flaps) which, encase the row carrying edges of the handle layers in a smooth U-shape lining.

When the cover is open, most types of contents are immediately partially visible to the persons to whom the presentation is being made. Thus, visual impact is achieved not only by the personalized cover but by the regions of the contents that are visible as soon as the cover is folded back.

For customized partial manufacture of the presentation folders by end users, it is presently preferred that peel-andstick pressure-sensitive adhesive be employed. In accordance with one aspect of the invention, such adhesive in many instances covers portions of handle flap regions. Thus, when these handle flap regions are pressed into contact with other portions of the folder, they remain in place. The portions of the handle flaps provided with adhesive are adjacent portions of the folder that are not handle flaps, and that also have adhesive, the product thus being manufacturable, at the factory, at very low cost.

In accordance with an additional aspect of the invention, the adhesive in most instances is provided on a single side of the blank, for maximized economy of production.

Figure 11:
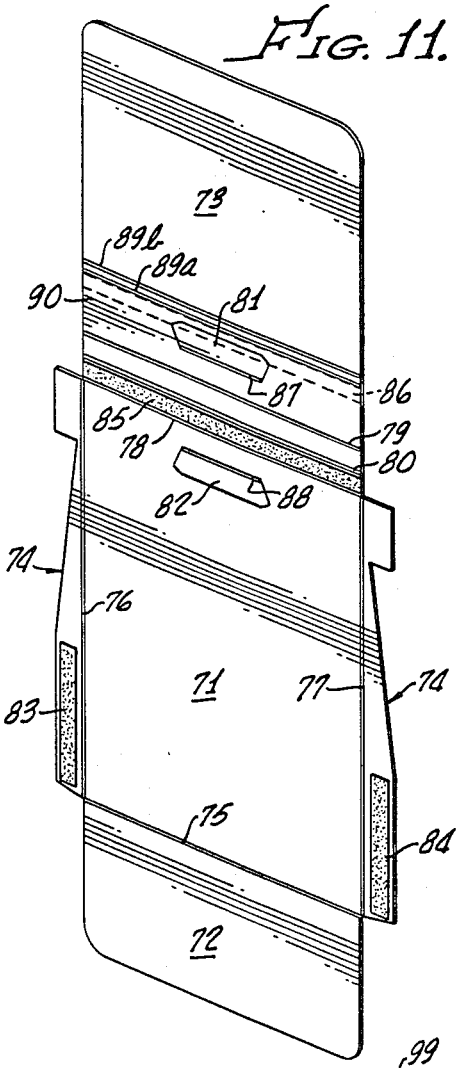
FIG. 11 is an isometric view of a blank for a fourth embodiment of presentation folder.
Figure 12:
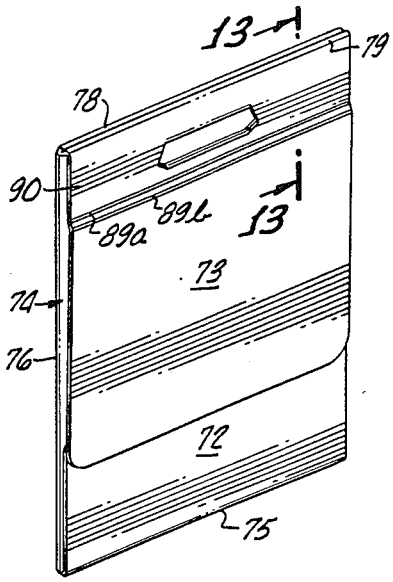
Figure 13:
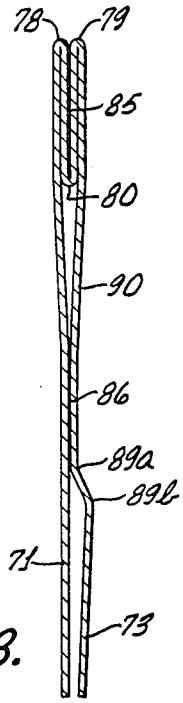
Figure 14:
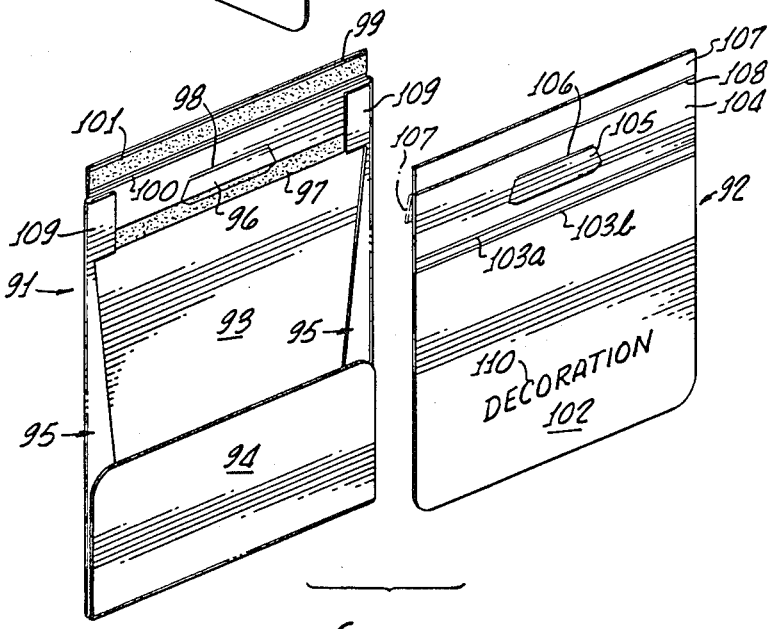
Figure 15:
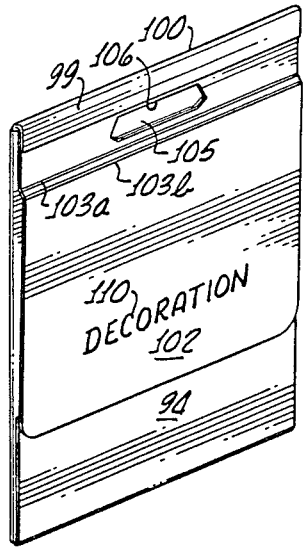

12 is an isometric view illustrating the completed folder made from the blank of FIG. 11;

FIG. 13 is an enlarged fragmentary sectional view on line 13—13 of FIG. 12;

FIG. 14 is an exploded isometric view of a blank for a fifth embodiment of presentation folder; and FIG. 15 is an isometric view illustrating the completed folder made from the blank of FIG. 14.

DETAILED DESCRIPTION OF THE PREFERRED EMBODIMENTS

The embodiment shown in FIGS. 1–6 is preferred for heavy contents of the presentation folder.

Figures 1, 2:
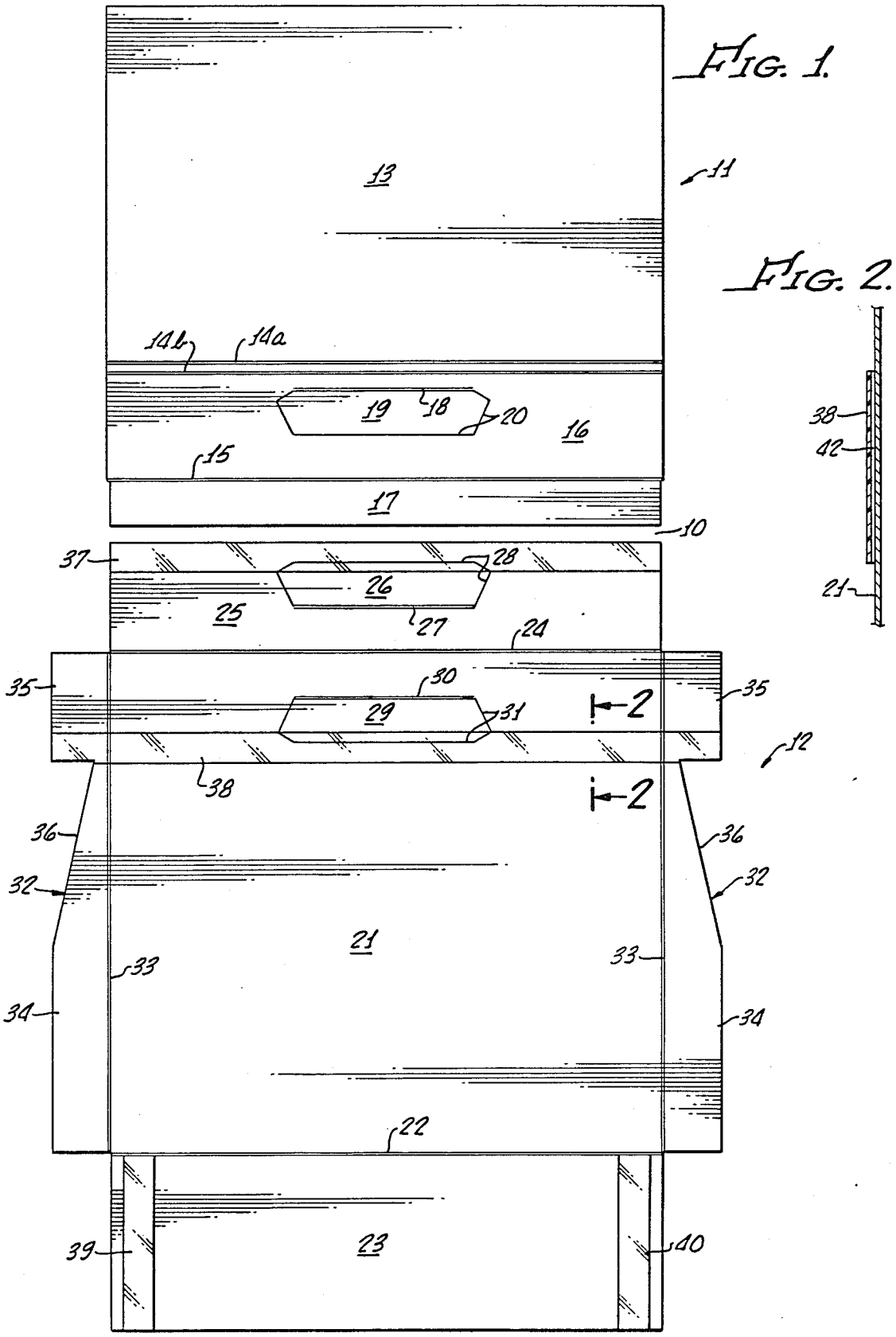
FIG. 1 is a plan view of a blank for a first embodiment of the present presentation folder.
FIG. 2 is an enlarged fragmentary sectional view on line 2—2 of FIG. 1.

Shown in FIG. 1 is an elongated, generally rectangular blank that, in the illustration, has been separated at 10 into two components numbered 11 and 12. As originally manufactured, instead of being in two pieces with the separation at 10, the blank is continuous and has a cut line at 10 so that the user can make the separation at that point. The cut line may be, for example, one where the edges (at 10) of the two components 11,12 are held together only by extremely small and widely-spaced connector regions so as to facilitate the separation.

In all embodiments of the present invention, the preferred material forming the blanks and thus the presentation folders is cardboard.

Blank component 11 has a large rectangular portion 13. This is the front cover or flap. At the bottom edge of front cover 13 (as viewed in FIG. 1) is a double score line or two relatively closely spaced fold lines **14*a*, 14*b***.

Each such line 14a,14b and every other score line described below relative to the embodiment of FIGS. 1–6, is perpendicular to the longitudinal axis of the elongated blank 11,12, except as specifically stated below.

Between score lines 14a,14b and the bottom edge of blank component 11 is an additional score line 15. The blank region 16, formed between score lines 14b,15, is a reinforcing (and cover-mounting) region of the presentation folder.

The blank portion between score line 15 and the bottom edge of blank component 11, as viewed in FIG. 1, is a mounting-and-aligning (as well as reinforcing) flange 17. A short score line 18 is centrally formed in region 16, adjacent score line 14. Score line 18 is at one edge of a handle flap 19 in region 16. A cut line 20 extends down toward line 15 from one end of score line 18, then extends generally parallel to score line 15, then extends back up to the other end of score line 18, thereby forming a partially attached handle opening. Cut line 20 is such that handle opening flap 19 may be readily bent away from the blank except at score line 18 which serves as a pivot region.

Blank component 12 has a relatively large rectangular central region 21 which is the back of the presentation folder. A fold line 22 at the bottom edge of back 21 separates back 21 from a rectangular region 23 located at the bottom of the blank. Such region 23 constitutes the front side of the pocket of the presentation folder. Preferably, the distance between fold line 22 and the bottom edge of pocket portion 23 is greatly less than the distance between fold line 22 and the upper edge of back 21.

The upper edge of back 21 is at a fold line 24. This fold line separates cover 21 from a cover-mount portion 25 that extends upwardly to the upper edge of blank component 12.

In cover-mount portion 25 is a handle flap 26 corresponding to the above-described handle flap 19, but having its score line on the other side. Thus, there is a score line 27 and a cut line 28, the score line being relatively adjacent fold line 24. The handle flap 26 thus extends toward flap 19 from score line 27. A third handle flap 29 corresponding to flap 19 is provided in the upper portion of back 21, having a score line 30 adjacent score line 24, and a cut line 31 remote from score line 24.

Handle flaps 26,29 are mirror images of each other, symmetrically spaced from score line 24. Handle flap 19 is so spaced from the fold line 15 as to be registered with the openings for flaps 26,29 when blank portions 11,12 are assembled with each as described relative to FIGS. 3–6.

There are side flaps 32 connected to respective edges of back 21 at score lines 33. Score lines 33 are uniquely parallel to the longitudinal axis of blank 11,12. Furthermore, score lines 33 are coincident with imaginary straight lines containing the side edges of back 21, pocket front 23, covermount portion 25, etc.

The side flaps 32 are mirror images of each other relative to the longitudinal axis of blank 11,12. Each side flap has a lower portion 34 and an upper or ear portion 35. Each portion 34,35 is generally rectangular, except that each lower portion 34 has an upper-outer edge 36 that converge upwardly toward the adjacent score line 33 from generally the central region of such side flap portion 34. The lower edge of each side flap ear portion 35 is somewhat below the bottom region of cut line 31 for handle flap 29. The upper end of each inclined edge 36 meets the bottom edge of each ear portion 35 at a point spaced somewhat outwardly from the associated fold line 33.

Four conventional "peel-off" adhesive strips are formed of peel-off paper strips 37–40 (FIG. 1), which respectively cover strips of pressure-sensitive adhesive 41–44 (FIG. 3) All are secured on the same side of the blank, for economy of production. FIG. 2 shows, in enlarged section, peel strip 38 and the associated adhesive 42, showing the peel-off or pressuresensitive adhesive strips. It is to be understood that the remaining peel-off adhesive strips correspond generally to what is illustrated in FIG. 2.

Peel-off adhesive strip 37,41 is provided across the top edge of cover-mounting portion 25. During application of this peel-off adhesive strip, the edge portion of handle flap 26, remote from fold line 27, is covered by the strip.

Peel-off adhesive strip 38,42 is secured to and across the top of back 21, at the same level as—and also on—the lower edge portions of ears 35, covering the edge of handle flap 29 remote from fold line 30. Preferably the adhesive strips 37,41 and 38,42 which cover the edge portions of handle flaps 26,29 are secured to the blank before the handle cuts are made, so that parts of such cuts go through parts of the adhesive strips also.

Peel-off adhesive strips 39,43 and 40,44 are in the present embodiment, secured on front cover 23, spaced somewhat from and parallel to the side edges thereof.

Aside from pressure-sensitive adhesive, and for mass manufacture, the assembly means may be other types, such as hot-melt or contact glues. Also, staples, rivets, grommets or other decorative or plain fasteners or decorative stitching may be employed in some places.

DESCRIPTION OF THE METHOD, EMBODIMENT OF FIGS. 1–6

The blank shown in FIG. 1 is manufactured at the factory, with blank components 11,12 removably associated with each other at region 10 as by widely-spaced breakable connection portions of the cardboard. Various blanks are then packaged and shipped to the customer.

Figure 3:
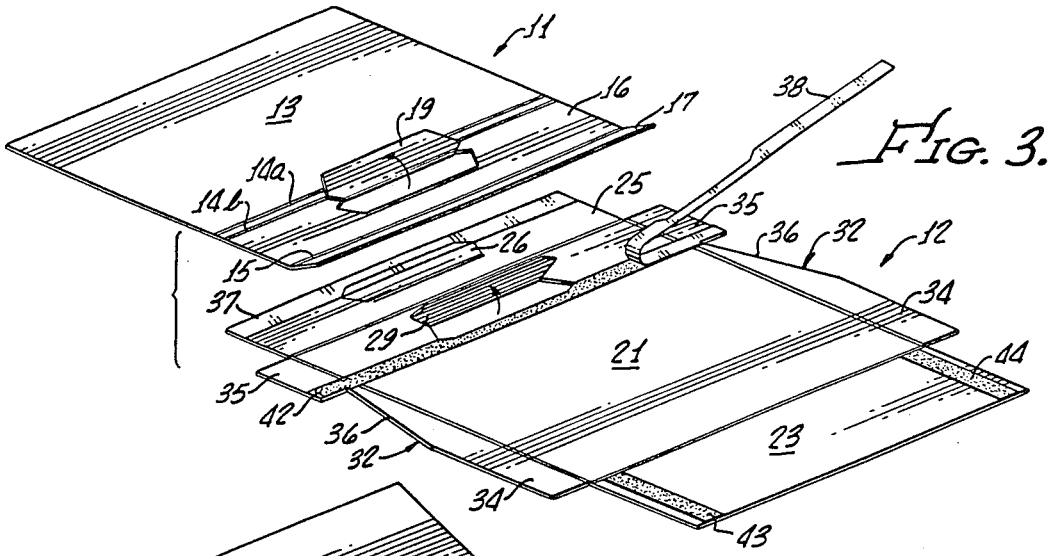
FIGS. 3–5 are isometric views illustrating different portions of the method for converting the blank of FIG. 1 to the finished presentation folder.
Figure 4:
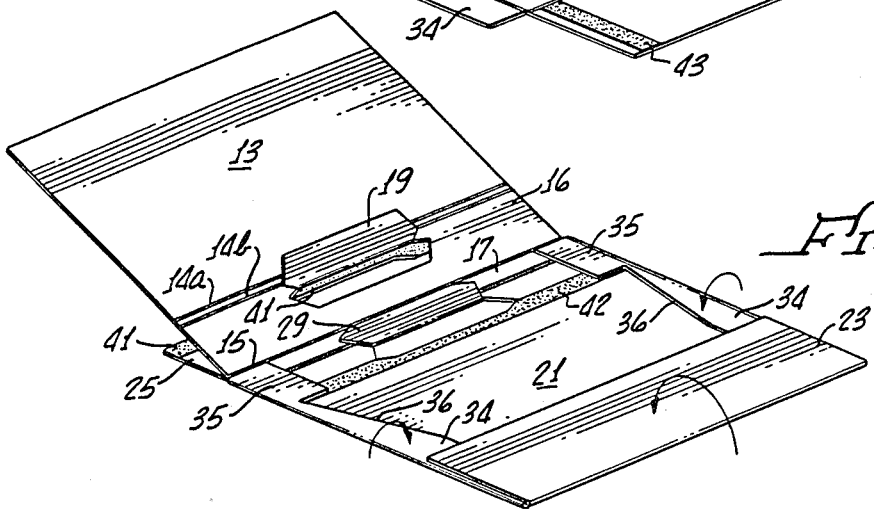

When the customer desires to make up a decorative portfolio-presentation folder, blank component 11 is separated from blank component 12 at the separation region 10. Because the blank component 11 is relatively small, and does not have any adhesive on it, the side of cover flap 13 opposite that shown in FIG. 1, 3 and 4 is easily decorated in any manner desired by the user, as by use of standard office machines. Decorations (such as company logos, school emblems, calligraphy, drawings, pictures, graphs, etc.) may be effected by laser printers, office copiers, headliners, embossers, color platers, foil stampers, laminators, etc., as found today as desk-top publishing equipment in most offices, schools, institutions, and increasingly also in homes. For purposes of this application, the word "DECORATION" is written in FIG. 5 and marked by numeral 45. The word "DECORATION" is of course not restrictive, but may include any writing, pictures, embossing, foil stamping, etc.

After decoration, the decorated cover or flap 13 is secured to the remainder of the folder. The pressure-sensitive adhesive is reusable for detachment and reattachment of parts, so that different types of decorated front flaps 13 may be employed at different times or for clients or customers, using but a single component 12.

Accordingly, the front cover may be peeled away from the other folder component, or mechanically detached in the case of, for instance, stapled or riveted assembly, and replaced by a different front cover having a different decoration, color, texture, etc. when desired.

FIG. 3 shows the cover about to be assembled to the book. To mount the front cover, peel strips 38,39,40 are removed from blank component 12, but peel strip 37 is preferably not removed therefrom initially. In addition, handle flap 19 is bent upwardly about its score line 18 so as to be over a portion of cover or flap 13.

The side flaps 32 are next bent inwardly from the position shown in FIG. 3 to that shown in FIG. 4, and are held in such position due to the lasting-securing action effected by portions (on ears 35 and adjacent thereto) of adhesive strip 42. Then, the pocket front 23 is bent upwardly from the FIG. 3 position to the FIG. 4 position, so as to form a pocket at the lower region of back 21.

Handle flap 29 is bent upwardly and secured in fully-bent relationship (FIGS. 2 and 3) because a portion remote from its fold line 30 has adhesive thereon from strip 42, so that pressing downwardly on the bent flap 29 holds it bent and adhesively-secured to the upper part of back 21, and also to front cover flange 17 (which has previously been positioned over part of back 21).

Before bending and securing handle flap 29, the front cover flange 17 is bent upwardly, and is slidably inserted downwardly or hooked into the spaces between back 21 and the upper edges of ears 35. The ears 35 of the side flaps operate as positioning, locating and "squaring" members for the front cover 13, in that the flange 17 is slidably shifted by the operator as far as possible beneath the inwardly-folded ears 35. Shifting is continued until the extreme upper edges of such ears engage region 16 of blank component 11 and prevent further insertion, the cover being bent about score line 15. The cover flap 13 is in the precise, squared position desired and, furthermore, the opening for handle flap 19 is precisely registered with the openings for handle flaps 26 and 29. With the flange 17 inserted behind the ears, the handle flap 29 is bent upwardly and adhesively secured to flange 17, to thereby help to hold this flange in position. Thereafter, the cover 13 and reinforcing region 16 are bent downwardly. Region 16 is pressed against the exposed intermediate portions of adhesive strip 42, so as to effectively secure the reinforcing region 16 to the upper portion of back 21. Then, peel strip 37 is removed, exposing adhesive strip 41, and the cover-mounting portion 25 of blank component 12 is bent downwardly over and adhesively secured to reinforcing region 16. Handle flap 26 is then bent downwardly through the now-registered handle openings (which were created by the outward bending of the handle flaps 19 and 29). Handle flap 26 is also reverse-bent until its outer edge having adhesive thereon—from adhesive strip 41—is firmly bonded to the underside of back 21, thereby providing both extra handle strength, as well as greater carrying comfort.

Figure 5:
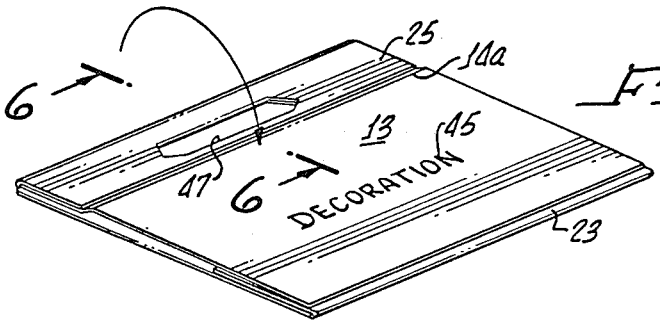

The result, which can be achieved in a short period of time, and using only decorating apparatus present in large numbers of offices, etc., is the custom finished portfolio-presentation folder shown in FIG. 5. The nature of the multi-layered handle assembly, as can readily be seen, provides this novel style folder with a substantial carrying capacity.

To use the folder, the front cover 13 is bent upwardly about its double score hinge **14*a*,14*b*, and desired material is introduced into the pocket defined between pocket front 23 and the lower region of back 21. Introduction of wide documents or pictures into the pocket is facilitated because of the presence of the inclined edges 36, which operate in the nature of a two-dimensional funnel. In addition, the upper regions of flap portions 34** aid in keeping the documents or pictures in position.

Figure 6:
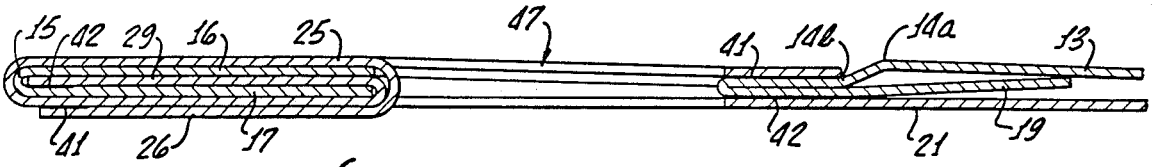
FIG. 6 is a greatly enlarged fragmentary sectional view on s 6—6 of FIG. 5, showings of the pressure-sensitive adhesive being omitted.

Even if the portfolio is inadvertently turned upside down when the cover is open, there is a built-in catch, formed by handle flap 19, preventing contents from sliding out. This catch 19, as illustrated in FIG. 6, extends into the upper region of the folder, and tends to trap the contents, keeping them from sliding along the back 21 and onto the floor.

After the presentation folder is thus filled, the decorative cover 13 is folded down, and a presentation is made to the customer. Aside from the unique portfolio presentation, the important first impression is amplified by the attractive, custom decorated, personalized front cover 13. When cover 13 is bent upwardly, the customer immediately sees that portion of the contents of the folder that extends above the upper edge of pocket front 23. Thereafter, the contents are removed for detailed review. The double hinge **14*a*, 14*b* of flap 13 provides easier opening and gravity closure along with a less visible assembly seam and snag-free mounting edge between parts 13 and 25 (see FIGS. 5,6), presenting a more smoothly integrated appearance. The space between the two score lines 14*a*,14*b* of this double hinge is greater than the thickness of the edge of region 25 (where adhesive 41 is applied), so that score line 14*a* is positioned outwardly of this edge, so as to partially mask this edge when the cover flap 13 is closed, as in FIG. 6**.

Because of the reusable nature of the conventional peeloff pressure-sensitive adhesive, the cover flap, after decoration and assembly, can be readily removed and replaced by another differently decorated cover flap, thereby greatly increasing versatility of the folder. Furthermore, the availability of factory made blanks in different colors allows mixing of the front cover flaps in a large variety of two-color combinations.

EMBODIMENT OF FIGS. 7 AND 8

Figure 7:
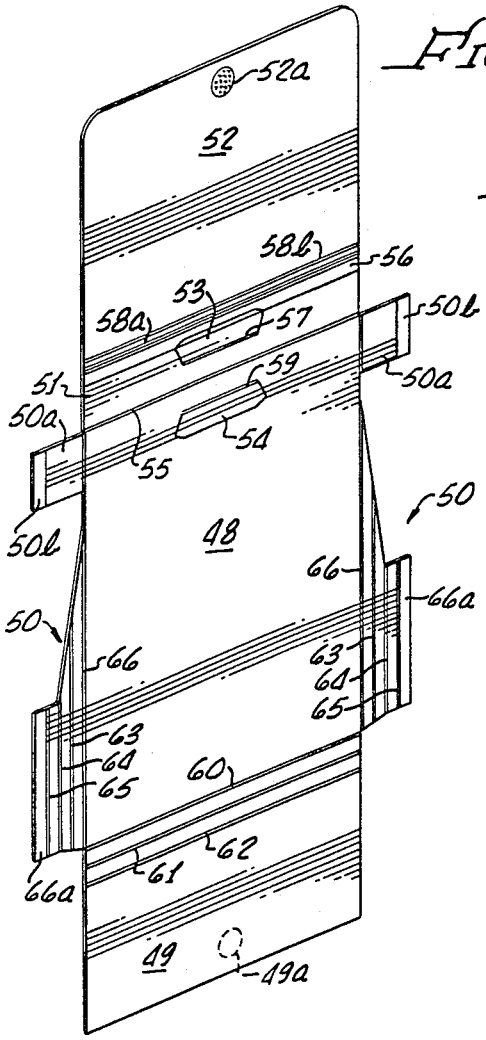
FIG. 7 is an isometric view of a blank for a second embodiment of presentation folder.

Referring to FIG. 7, the illustrated blank has a back 48, pocket front 49, side flaps 50 and **50*a*, a reinforcing and cover-mounting region 51, and a cover flap 52**.

Handle flaps 53,54 are provided, being mirror images about a score or fold line 55. A strip 56 of pressure-sensitive adhesive extends across the upper edge of reinforcing region 51, including the portion of upper handle flap 53 remote from its score line 57. A double score line or fold line **58*a*,58*b* is provided adjacent the upper edge of the adhesive strip 56. The score line 59 for the lower handle flap 54** is at the upper edge of such flap.

In the present embodiment, to accommodate bulkier contents, there are parallel-scored accordion regions in the side flaps 50 and adjacent the junction between back 48 and pocket front 49. For example, as illustrated in FIG. 7, there are three parallel fold lines 60–62 between back 48 and pocket front 49. Such fold lines 60–62, like all others described thus far relative to the present embodiment, are perpendicular to the longitudinal axis of the blank.

There are three fold lines 63–65 in each side flap 50, such fold lines being parallel to the longitudinal axis of the blank. These fold lines are additional to the fold lines 66 formed at the junctions between flaps 50 and back 48. It is to be understood that there may be additional fold lines corresponding to 60–62 as well as 63–65, as such accordion pleats will keep all semi-finished or finished assembled presentation folders flat for storage.

Strips 66*a* of peel-off pressure-sensitive adhesive are provided longitudinally of the blank at the outer parts of the lower portions of side flaps 50. Such strips border on the outermost score lines 65.

Except for the additional score lines, the side flaps 50 correspond in shape, generally, to those described relative to the previous embodiment, tapering upwardly toward, but ending slightly below, outwardly extending ears 50*a* which have peeloff pressure-sensitive adhesive strips 50*b* along their outer edges.

Figure 8:
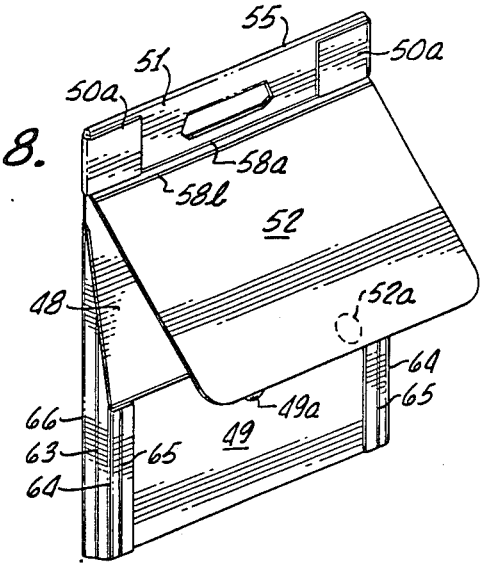
FIG. 8 is an isometric view of the finished folder made from the blank of FIG. 7.

In forming the blank of FIG. 7 into the completed portfolio folder of FIG. 8, the pocket front 49 is first bent upwardly, following which the side flaps 50 are bent inwardly. The adhesive strips 66*a* are pressed against side regions of the pocket front 49, thus forming a relatively large pocket that can hold articles, samples, stacks of paper, etc. The pocket can be made expandable by causing the score lines to be such that the adjacent blank portions fold in opposite directions, accordion style.

After the pocket is formed, handle flap 54 is folded upwardly about its score line 59, following which reinforcing region 51 is folded downwardly about its score line 55, and adhesive strip 56 is pressed against back 48. Handle flap 57 is now folded through the double handle opening and secured by its adhesive lip to the upper back portion 48. The ear portions of side flaps 50*a* are now folded inwardly over outer parts of reinforcing region 51 and adhesively secured thereto by adhesive strips 50*b* to provide further reinforcing, as can be seen in FIG. 8. The cover flap 52 may then be folded out about double fold lines 58*a*,58*b* to load or expose the cbntents, as illustrated in FIG. 8, or may be held closed by Velcro closure patches 52*a*,49*a* (or equivalent plastic snap buttons, clasps or the like) secured to the cover and pocket front respectively. The space between the two parts of the double hinge 58*a*,58*b* is somewhat greater in this embodiment to accommodate the greater thickness of the pocket.

The expandable or enlarged pocket construction described relative to FIGS. 7 and 8 may also be employed relative to the embodiment of FIGS. 1–6 as well as other embodiments described herein.

The embodiment of FIGS. 7 and 8 may have the blank separable into two components along fold line 55 if desired, so that the cover flap portion may be decorated as a single, independent sheet. In such case the adhesive strip 56 would be removed from the cover flap part and replaced in a corresponding location on the back part 48.

The embodiment of FIGS. 7 and 8, like several of the other disclosed embodiments, such as those of FIGS. 9 and 10 and FIGS. 13, 14, and 15, in addition to being sold as flat, unassembled blanks, may be mass produced for sale in fully assembled form for product marketing, merchandising, sampling and, of course, for literature presentation. For mass production, these embodiments are slightly modified by replacing the pressure-sensitive adhesive strips by production gluing, stapling, or riveting.

EMBODIMENT OF FIGS. 9 AND 10

Figure 10:
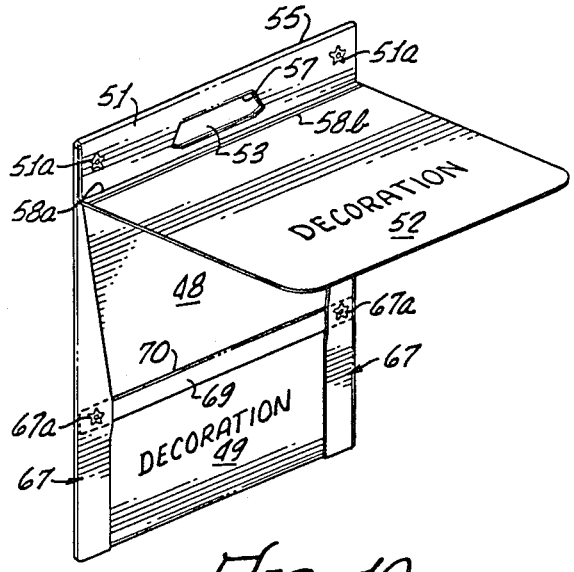
FIG. 10 is an isometric view illustrating the completed folder made from the blank of FIG. 9.
Figure 9:
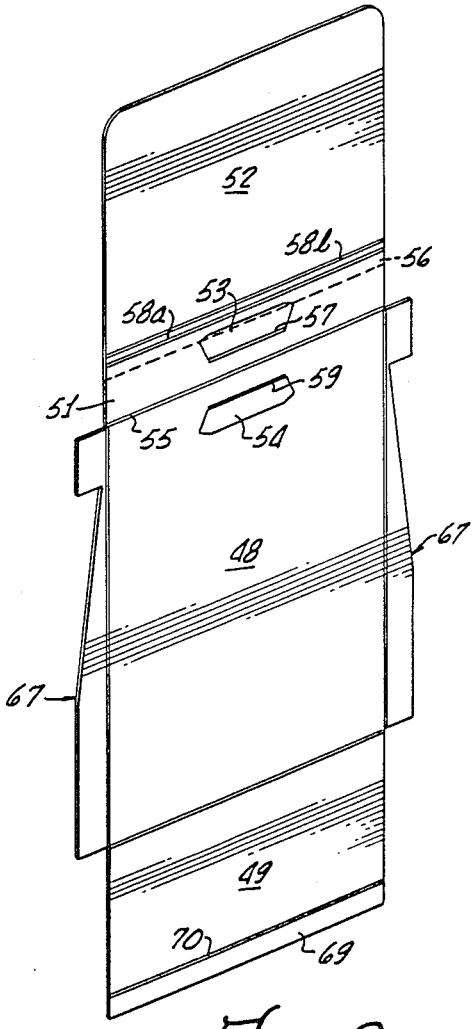
FIG. 9 is an isometric view of a blank for a third embodiment of presentation folder.

FIGS. 9 and 10 represent a smaller one-piece version of the presentation folder, sized to be custom decoratable on contemporary office and desk-top publishing equipment in its entire blank version. The embodiment of FIGS. 9 and 10 is identical to that of FIGS. 7 and 8, except that there is no expanded or accordion relationship relative to the pocket construction. Furthermore, there is a reinforcing and cutpreventing flange 69 at the upper edge of the pocket front, as viewed in FIG. 10 (this being the lower edge as viewed in FIG. 9). The numbers employed relative to the embodiment of FIGS. 9 and 10 are identical to those used in FIGS. 7 and 8, except relative to the side flaps and the indicated flange.

The side flaps in FIGS. 9 and 10 are numbered 67, but have no adhesive and correspond generally to those described relative to FIGS. 1–6.

In assembling the embodiment of FIGS. 9 and 10, the reinforced flange 69 is bent upwardly about its score or fold line 70, so that flange 69 will be folded on the inside of the remainder of the pocket front.

Now the pocket front 49 is folded upwardly, side flaps 67 are bent inwardly and secured by staples, decorative rivets or grommets 67*a* to flange 69 and pocket front 49 (but not to back 48). The upper portion of the presentation folder is assembled as described above relative to FIGS. 7 and 8, with reinforcing region 51 folded against and secured to back 48 by rivets, staples, decorative grommets, etc. 51*a*.

The flange 69 provides a strengthening effect and, furthermore, prevents any tendency of the cardboard edge to cut the user on occasion. It is to be understood that the flange 69 may be employed in the other embodiments described above and below.

As the embodiment of FIGS. 9 and 10 employs no adhesive, the entire unitary blank, or the two parts of the blank, if separated along line 55, may be suitably custom decorated by the user prior to assembly. Suitable decoration can be placed on the front cover flap 52, on the pocket flap 49, and on the outside (not shown) of back 48. In a small size, one piece arrangement of this embodiment, the entire blank may be decorated on contemporary office or desk top equipment and then instantly assembled, either with pre-applied adhesive, or glue, or other suitable fasteners such as staples, rivets or grommets, etc..

EMBODIMENT OF FIGS. 11–13

Unlike the illustrations of the other embodiments described in this application, FIG. 11 shows the bottom side of the blank.

The blank shown in FIG. 11 has a back 71, pocket front 72, cover flap 73, and side flaps 74. Score or fold lines 75–77 are provided for the pocket front and side flaps. An additional score line 78 is provided at the upper edge of back 71.

Two score lines 79,80 are formed above score line 78. Preferably, the distance of upper score line 79 from score line 78 is twice the distance between lower score line 80 and line 78.

Handle flaps 81,82 are provided, each having its score line 87,88 relatively adjacent score lines 79–78. The handle flaps 81 and 82 are mirror images relative to score line 80.

Peel-off adhesive strips 83–86, inclusive, are provided on the blank.

Strips 83 and 84 are on the lower portions of side flaps 74. Unlike the other adhesive strips described herein relative to the side flaps, adhesive strips 83,84 are on the underside of the blank (shown in FIG. 11) as distinguished from the upper side thereof.

Adhesive strip 85 is provided between score or fold lines 78 and 80, on the underside of the blank.

Adhesive strip 86 is on the upper side of the blank and thus is shown in dashed lines in FIG. 11. It extends across the blank, and across the edge region of upper handle flap 81 remote from the score line 87 for such handle flap. Similarly to handle flap 81, flap 82 has a score line 88 relatively adjacent, preferably, the other handle.

A double score line or double hinge **89*a*,89*b* is provided above the upper handle flap 81, preferably at the upper edge of adhesive strip 86 thereon. The region of the blank between score lines 79 and 89*a*,89*b* may be termed the reinforcing region and is numbered 90**.

The blank of FIG. 11 is quickly assembled into the finished presentation folder of FIG. 12 by first removing all of the peel strips from adhesive strips 83-86, then folding the side flaps 74 inwardly (downwardly into the paper in FIG. 11), ° then folding pocket front 72 inwardly (downwardly into the paper in FIG. 11) and pressing the pocket front against the adhesive strips 83,84 so as to form the pocket.

Then, bends are made at score lines 78–80, inclusive, so as to cause the adhesive strip 85 to adhere flatwise to the blank region immediately there above (the region between fold lines 79 and 80), as seen in FIG. 13. The handle flap 82 is bent upwardly (into the paper in FIG. 11), and the cover flap 73 and reinforcing region 90 are bent conjointly downwardly (into the paper as viewed in FIG. 11) about score or fold line 79. Then, the adhesive strip 86 is pressed against portions of the side flaps 74 and of back 71.

The handle flap 81, having adhesive at the upper marginal edge thereof, is then bent downwardly through the opening left by the bending of handle flap 82, and rotated upwardly until adhesively secured against the upper handle portion of the back of the folder, thereby unifying the handle layers and providing greater strength and carrying comfort.

FIG. 13 shows that there are four carrying layers above the handle opening (above fold line 80) and laterally outwardly therefrom. There is a strong, thick four-ply mass of cardboard, formed by the serpentine pattern as shown at the upper portion of FIG. 13, further reinforced by the two inverted handle flaps (not shown in FIG. 13). Adhesive layers 85 and 86 hold all of the plies together.

Preferably, in the completed folder, the fold line 80 is at the same elevation as the upper edge of the handle opening formed by bending of the handle flaps 81,82. At the weight bearing parts of the handle, there are six plies of cardboard, as distinguished from four.

Like the embodiment of FIGS. 9 and 10, the embodiment FIGS. 11–13 can be provided as a single unitary blank separable along line 80, thus providing a detachable, decoratable and re-attachable or replaceable front cover. It can be assembled with either the illustrated pre-applied pressure-sensitive adhesive or staples, rivets, grommets or the like.

EMBODIMENT OF FIGS. 14 AND 15

Two blank components 91,92 are provided, being preferable manufactured together as a single sheet as described relative to the first embodiment and then separated at a tear or cut line. Blank component 91 has a back 93, pocket front 94, said flaps 95, handle flap 96, and a peel-off pressure-sensitive adhesive strip 97 that extends across the back 93 and over the lower edge of the handle flap—spaced relationship below the score line 98 of the handle flap.

In addition, there is provided at the upper edge of blank component 91 a flange 99 having a score line 100 at the lower edge thereof, where the flange is associated with back 93. A peel-off pressure-sensitive adhesive strip 101 is provided on the flange.

Blank component 92 has a front cover or flap 102 that is connected at a double score or hinge line **103*a*,103*b* with a reinforcing region 104. Region 104 has a handle flap 105, having a score line 106** at its upper edge.

A flange 107 is formed along the upper edge of reinforcing region 104, being associated with such region at a score line 108.

To assemble the elements of FIG. 14 into the completed presentation folder of FIG. 15, the blank components 91,92 are separated from each other, following which the side flaps 95 of blank 91 are bent inwardly and the pocket front 94 is bent upwardly, it being understood that there is pressure-sensitive adhesive (not shown) between these elements so as to keep the pocket front 94 in position. After separation from the component 91, the front cover component 92, as a single, independent sheet of relatively small size is provided with its custom decorations by any suitable processing through a standard office type machine or copier, for example.

Handle flap 105 of component 92 is then folded upwardly about fold line 106 (into the paper) and reverse-bent so as to be parallel to reinforcing region 104 and adjacent fold line 108. Then, flange 107 is bent about fold line 108 downwardly (into the paper), and the decorated blank component 92 is moved adjacent blank component 91 so that bent, downwardly extending flange 107 may be—and is—inserted (hooked) behind the upper "ear" portions 109 of side flaps 95. Stated otherwise, each end of flange 107 is between an ear portion 109 of side flap 95 and the region of back 93 beneath such ear. Thus, the flange 107 and ears 109 cooperate to align the handle openings with each other, and to make cover 102 perfectly square with back 93, whereupon reinforcing region 104 is pressed down and secured to adhesive strip 97 of component 93.

Then, handle flap 96 is reverse bent upwardly about its fold line 98, passing forwardly through the opening for handle flap 105, and adhering adhesively to the front side of reinforcing region 104.

Finally, flange 99 is bent forwardly and adhesively secured over the ears 109, over the upper portion of reinforcing region 104, and over handle flap 96.

The embodiment of FIGS. 14 and 15 is one in which the blank portion 92 is decorated as schematically represented at "DECORATION", this being done by the laser printers, headliners, etc., as described relative to the first embodiment of the present invention. The "DECORATION" is numbered 110.

The various score lines or fold lines are preferably constructed and located as described in my co-pending U.S. patent application Ser. No. 069,772, filed July 6, 1987, for a Hot Melt Glue Binder. Said application is hereby incorporated by reference herein.

The foregoing detailed description is to be clearly understood as given by way of illustration and example only, the spirit and scope of this invention being limited solely by the appended claims.

What is claimed is:

1. A portfolio-presentation folder, which comprises:

(a) a generally rectangular back, (b) a pocket front, (c) means to secure said pocket front to edge portions of said back, said pocket front extending upwardly from the lower edge of said back a distance less than the vertical dimension of said back, whereby the upper edge of said pocket front is spaced below the upper edge of said back, said upper edge of said pocket front not being connected to said back, whereby reports, pictures and other materials may be inserted downwardly into the pocket between said pocket front and said back, (d) a cover flap having a cover region connected to and overlying said back at a back region that is spaced above said upper edge of said pocket front, said cover flap having a lower portion pivotally connected to said cover region.

said cover flap extending downwardly sufficiently far that the lower portion thereof overlies at least the upper part of said pocket front, and (e) handle means provided on said back and cover regions, said handle means comprising first and second registered openings in said back and cover regions, and a handle flap formed integrally with one of said regions and bent through at least one of said openings into juxtaposition with one of said regions.

2. The invention as claimed in claim 1, in which said back, said pocket front, and said handle means are formed from a single blank of stiff sheet material.

3. The invention as claimed in claim 2, in which pressure sensitive adhesive is provided on said blank to secure portions of said presentation folder to other portions thereof.

4. The invention as claimed in claim 1, in which the exterior surface of said cover flap is provided with a decoration selected from a class consisting of printing, pictures, embossing, and foil stamping, and in which fastening means are provided to connect said cover flap to said back.

5. The invention as claimed in claim 1, in which a reverse-bent flange is provided on said upper edge of said pocket front, whereby the extreme upper part of said upper edge is not a raw edge.

6. The invention as claimed in claim 1, in which a plurality of horizontal score lines are provided at the lower edge of said pocket front, in which side flaps are provided at the junctions between the sides of said back and the sides of said pocket front, in which a plurality of vertical score lines are provided in each of said side flaps, and in which said side flaps, said horizontal and vertical score lines, and said back are so related that said pocket front can be spaced forwardly a substantial distance from said back to increase greatly the size of said pocket.

7. A portfolio-presentation folder, which comprises:

(a) a generally rectangular back, (b) a pocket front, (c) means to secure said pocket front to edge portions of said back, said pocket front extending upwardly from the lower edge of said back a distance less than the vertical dimension of said back, whereby the upper edge of said pocket front is spaced below the upper edge of said back.

said upper edge of said pocket front not being connected to said back, whereby reports, pictures and other materials may be inserted downwardly into the pocket between said pocket front and said back.

(d) a cover flap connected to said back at a region that is spaced above said upper edge of said pocket front, said cover flap extending downwardly sufficiently far that the lower portion thereof overlies at least the upper part of said pocket front, and (e) handle means provided on said back at a location above the upper part of said cover flap, said securing means(c) comprising side flaps on said back, said side flaps being bent inwardly over said back, regions of said side flaps above said upper edge of said pocket front converging upwardly toward the side edges of said back, and thus acting in the nature of a two-dimensional funnel.

8. A portfolio-presentation folder, comprising:

(a) a generally rectangular back, (b) a pocket front connected at its bottom and side edges to said back, the upper edge of said pocket front not being connected to said back, whereby proposals, pictures and other materials may be inserted downwardly between said pocket front and said back, (c) cover mounting and handle means provided at the upper region of said back, above said upper edge of said pocket front, said cover mounting and handle means including first and second layers, said first and second layers having registered finger openings therein through which the fingers of the user may be extended, a handle flap formed integrally with one of said layers and bent from at least one of said finger openings to extend along one of said layers upwardly from said opening, and (d) a cover pivotally connected, at a location above said upper edge of said pocket front, to said cover mounting and handle means, said cover extending downwardly over at least the upper region of said pocket front said cover having a reinforcing region overlapping at least part of said back upper region, said reinforcing region having a cover finger opening registered with said first mentioned finger openings, said handle flap extending through said cover finger opening.

9. The invention as claimed in claim 8, in which said cover mounting and handle portion includes at least two layers additional to said first and second layers, there thus being four layers at least above said openings, said four layers being arranged in a close accordion fold.

10. The invention as claimed in claim 9, in which the two middle layers in said accordion fold are adhesively secured to each other, and in which adhesive is provided between the two outer layers at a location below said openings.

11. A portfolio-presentation folder, comprising:

(a) a generally rectangular back, (b) a pocket front connected at its bottom and side edges to said back, the upper edge of said pocket front not being connected to said back, whereby proposals, pictures and other materials may be inserted downwardly between said pocket front and said back.

(c) cover mounting and handle means provided at the upper region of said back, above said upper edge of said pocket front, said cover mounting and handle means including first and second layers, said first and second layers having registered finger openings therein through which the fingers of the user may be extended, and (d) a cover pivotally connected, at a location above said upper edge of said pocket front, to said cover mounting and handle means, said cover extending downwardly over at least the upper region of said pocket front, said cover mounting and handle means (c) comprising a cover mounting portion at the upper part of said back, said cover mounting portion being pivotally connected to said back at a fold line located above said upper edge of said pocket front, said cover mounting and handle means (c) further comprising a reinforcing region pivotally connected to said cover, said registered finger openings being provided in said cover mounting portion and in said reinforcing region, an additional finger opening registered with said registered finger openings, and provided in said back at a region located below and adjacent said fold line, and said reinforcing region being sandwiched between said cover mounting portion and said back region located below and adjacent said fold line.

12. The invention as claimed in claim 11, in which a handle flap is provided at least two of said finger openings, one of said handle flaps being bent through all of said finger openings and then secured in a plane parallel to those of said cover mounting portion, said reinforcing region, and said region of said back below said fold line.

13. The invention as claimed in claim 12, in which said one handle flap has its fold line relatively remote from said pocket, and in which the other of said handle flaps has its fold line relatively adjacent said pocket, said other handle flap being bent downwardly and extending downwardly to a location substantially below the upper edge of said cover, whereby to act as a means preventing the contents of said pocket from falling out.

14. A portfolio-presentation folder, comprising:

(a) a generally rectangular back, (b) a pocket front connected at its bottom and side edges to said back, the upper edge of said pocket front not being connected to said back, whereby proposals, pictures and other materials may be inserted downwardly between said pocket front and said back, (c) cover mounting and handle means provided at the upper region of said back, above said upper edge of said pocket front, said cover mounting and handle means including first and second layers, said first and second layers having registered finger openings therein through which the fingers of the user may be extended, and (d) a cover pivotally connected, at a location above said upper edge of said pocket front, to said cover mounting and handle means.

said cover extending downwardly over at least the upper region of said pocket, a handle flap being provided in each of said finger openings, one of said handle flaps being bent through both of said finger openings and then secured in a plane parallel to those of said first and second layers.

15. The invention as claimed in claim 14, in which said one handle flap is bent about a fold line relatively remote from said pocket, and in which the other of said handle flaps is bent about a fold line relatively adjacent said pocket, said other handle flap being bent downwardly and extending downwardly to a location substantially below the upper edge of said cover, whereby to act as a means preventing the contents of said pocket from falling out.

16. A portfolio-presentation folder, comprising:

(a) a generally rectangular back, (b) a pocket front connected at its bottom and side edges to said back, the upper edge of said pocket front not being connected to said back, whereby proposals, pictures and other materials may be inserted downwardly between said pocket front and said back, (c) cover mounting and handle means provided at the upper region of said back, above said upper edge of said pocket front, said cover mounting and handle means including first and second layers, said first and second layers having registered finger openings therein through which the fingers of the user may be extended, and (d) a cover pivotally connected, at a location above said upper edge of said pocket front, to said cover mounting and handle means, said cover extending downwardly over at least the upper region of said pocket, a handle flap being provided in at least one of said openings, said handle flap having a score line on the edge thereof remote from said pocket, a strip of adhesive secured on the layer having said handle flap, a part of said strip extending across the part of said handle flap remote from said score line for said handle flap, and said handle flap being bent through both of said openings and secured by said adhesive part.

17. The invention as claimed in claim 16, in which a handle flap is also provided in the other of said openings, said latter handle flap having a score line on the edge thereof relatively adjacent said pocket, said latter handle flap being bent toward said pocket and extending to a region substantially below the upper edge of said cover.

18. A portfolio-presentation folder, comprising:

(a) a generally rectangular back, (b) a pocket front connected at its bottom and side edges to said back, the upper edge of said pocket front not being connected to said back, whereby proposals, pictures and other materials may be inserted downwardly between said pocket front and said back, (c) cover mounting and handle means provided at the upper region of said back, above said upper edge of said pocket front, said cover mounting and handle means including first and second layers, said first and second layers having registered finger openings therein through which the fingers of the user may be extended, and (d) a cover pivotally connected, at a location above said upper edge of said pocket front, to said cover mounting and handle means.

said cover extending downwardly over at least the upper region of said pocket front, a handle flap being provided in at least one of said openings, said handle flap having a score line on the edge thereof remote from said pocket, said handle flap being bent through both of said openings, and a handle flap being provided in the other of said openings, said latter handle flap having a score line on the edge thereof relatively adjacent said pocket, said latter handle flap being bent toward said pocket and extending to a region substantially below the upper edge of said cover.

19. A decorative portfolio-presentation folder, which comprises:

(a) a back (b) a pocket front secured to bottom and side edge portions of said back, the upper edge of said pocket front not being connected to said back, whereby proposals, pictures and other materials may be inserted downwardly between said pocket front and said back, (c) a cover flap, said cover flap not being integral with said back or with said pocket font, said cover flap being sufficiently small to be decorated in conventional desk-top decoration apparatus, (d) decoration means provided on the outer side of said cover flap, and (e) means to secure said cover flap to said back at a location above the upper edge of said pocket front.

20. The invention as claimed in claim 19, in which said securing means (e) comprises a cover-mounting portion provided at the upper edge of said back, there being a horizontal fold line between said cover-mounting portion and said back, and in which means are provided to secure said cover mounting portion to said cover flap.

21. The invention of claim 20 wherein said cover mounting portion has an edge superposed on said cover flap, said cover flap having first and second mutually spaced and mutually adjacent hinge lines, said first hinge line being positioned at said cover mounting portion edge, and said second hinge line being spaced from said edge by a distance greater than the thickness of said edge.

22. The invention as claimed in claim 20, in which said last-named means comprises a reinforcing region provided adjacent the upper edge of said cover flap, there being a score line between said cover flap and region so that said cover flap can pivot relative to said reinforcing region, and in which said cover-mounting portion bends forwardly over said reinforcing region and is secured thereto.

23. The invention as claimed in claim 22, in which said means to secure said cover mounting portion to said cover flap further comprises a strip of adhesive located on the upper part of said back above said score line that is between said cover flap and reinforcing region.

24. The invention as claimed in claim 22, in which registered handle-flap openings are provided in said back and in said reinforcing region, and in which a handle flap is provided in said back, an edge of said handle flap being provided with adhesive from said strip thereof.

25. The invention as claimed in claim 19, in which means are provided to cause said cove flap to be squarely registered with said back prior to securing of said cover flap to said back by said securing means (e).

26. A decorative portfolio-presentation folder, which comprises:

(a) a generally rectangular back, (b) side flaps provided on said back and bent inwardly relative thereto, (c) a pocket front secured to said side flaps, said pocket front cooperating with said back and with said side flaps to define an open-topped pocket, (d) a cover element, (e) a flange mounted on the upper edge of said cover element and associated therewith at a fold line, said flange being, at its ends, inserted between said back and the upper ends of said side flaps, (f) decoration means provide on the outer surface of said cover element prior to mounting of said cover element on the remainder of the folder, and (g) means to secure said back to said cover element.

27. The invention as claimed in claim 26, in which said securing means (g) comprises a back flange connected to said back at a fold line, said back flange being bent over and secured to a reinforcing region of said cover element, said reinforcing region being pivoted at a fold line to the main body of said cover element.

28. A method of making a portfolio-presentation folder comprising the steps of:

forming a pocket part blank of a relatively stiff sheet material, folding the blank into a pocket by folding a bottom por and side portions thereof inwardly toward an intermediate portion of the blank, providing a cut in an upper portion of said blank defining a first handle opening, having a first handle flap therein, providing a front cover blank formed of a relatively st material having a connection region and a front cover portion, forming a second handle cut out in said front cover blank defining a second handle flap, processing at least one surface of said front cover blank to provide decorative markings thereon, folding said handle flaps outwardly away from the respective blanks, securing the connection region of said front cover blank to an upper portion of said pocket part blank with the handle openings thereof in mutual registry, providing a hinge line extending across said front cover blank adjacent said connection region, and said front cover blank about said hinge line to provide a closure flap for the pocket of said pocket part blank.

29. The method of claim 28 including the steps of forming outwardly extending cover flap connecting ears at upper portions of said pocket part blank side portions, folding said ears inwardly and securing lower portions of said ears against said pocket part blank, said step of securing said connection region to said pocket part blank comprising the steps of inserting outer edge portions of said connection region between an upper portion of said pocket part blank and upper portions of said ears to thereby align said front cover blank with said pocket part blank.

30. The method of claim 28 wherein said step of providing a hinge line comprises providing first and second mutually spaced and mutually adjacent hinge lines extending across said front cover.

31. The method of claim 28 wherein said bottom portion is folded inwardly toward said intermediate portion and is spaced therefrom by a predetermined distance, said step of providing a hinge line comprising providing first and second mutually adjacent hinge lines spaced from one another by a distance that is not substantially less than said predetermined distance.

32. A portfolio-presentation folder, which comprises:

a generally rectangular back, a pocket front, (c) means to secure said pocket front to edge portions of said back, said pocket front extending upwardly from the lower edge of said back a distance less than the vertical dimension of said back, whereby the upper edge of said pocket front is spaced below the upper edge of said back, said upper edge of said pocket front not being connected to said back, whereby reports, pictures and other materials may be inserted downwardly into the pocket between said pocket front and said back, (d) a cover flap connected to said back at a region that is spaced above said upper edge of said pocket front, said cover flap extending downwardly sufficiently far that the lower portion thereof overlies at least the upper part of said pocket front, and (e) handle means provided on said back at a location above the upper part of said cover flap, said region comprising a back mounting and reinforcing region, said cover flap having a flap mounting and reinforcing region overlapping at least part of said back region, said handle means comprising first and second registered openings in said back and flap regions respectively, and a flap formed integrally with one of said regions at one of said openings and bent through said registered openings into juxtaposition with the other of said regions.

33. The folder of claim 32 including a second flap integral with the other of said regions at the other of said openings and bent from said other opening to extend between said back and flap regions, thereby providing further handle reinforcement.

34. The folder of claim 33 including a strip of adhesive secured to and extending across aid one region, said first mentioned flap having a free end, a portion of said strip of adhesive extending along said free end, said adhesive strip being interposed between said back and flap regions and securing said regions together, said first mentioned flap being secured to said other region by that portion of said strip of adhesive that extends along said free end.

35. The folder of claim 34 wherein said back includes a second back mounting and reinforcing region positioned adjacent said first mentioned back region, said second back region having a handle opening registered with said first and second openings and having a third flap folded out from said third opening, said first mentioned flap being bent through said third opening, said first mentioned back region being bent over an upper edge of said flap region, being bent over said second back region, and being secured to said flap region.

36. The folder of claim 33 wherein said cover flap is detachably connected to said back and is of a size and configuration for use in desk-top apparatus that can perform small lot or individual decoration selected from the class comprising printing, foil stamping, embossing, color plating, headlining and laminating.

* * * * *